US005660463A

United States Patent [19]

Ho

[11] Patent Number: 5,660,463

[45] Date of Patent: Aug. 26, 1997

[54] TERRESTRIAL GLOBE DEVICE

[76] Inventor: Ping-Huang Ho, 122-5, Jun Liao Road, Feng Yuan, Taichung Shien, Taiwan

[21] Appl. No.: 667,719

[22] Filed: Jun. 21, 1996

[51] Int. Cl.[6] ..... F21V 21/00

[52] U.S. Cl. ..... 362/269; 362/809

[58] Field of Search ..... 362/280, 269, 362/809, 806, 363; 446/485, 242

[56] References Cited

U.S. PATENT DOCUMENTS 2,115,372 4/1938 Peterson ..... 362/280

2,333,475 11/1943 Dupler ..... 362/809

3,049,813 8/1962 List ..... 446/485

*Primary Examiner*—Y. My Quach

[57] ABSTRACT

A terrestrial globe device comprises a main body which includes a seat, a curved rod disposed on the seat, and a transparent globe positioned by the curved rod. A box which is connected to a lower end of the curved rod has a driving mechanism therein. An elastic rod extends upward from the box. A bulb socket is disposed on the elastic rod. A bulb is disposed on the bulb socket. An integrated circuit board with a contact-actuation switch is disposed in the seat to control the driving mechanism via wires.

1 Claim, 3 Drawing Sheets

TERRESTRIAL GLOBE DEVICE

BACKGROUND OF THE INVENTION

The invention relates to a terrestrial globe. More particularly, the invention relates to a terrestrial globe device which has a contact-actuation switch to trigger the voice and the rotating light.

Most terrestrial globes cannot produce light nor voice while rotating. Some terrestrial globes can produce fixed light, but they cannot produce rotating light.

SUMMARY OF THE INVENTION

An object of the invention is to provide a terrestrial globe device which has a contact-actuation switch to trigger the voice.

Another object of the invention is to provide a terrestrial globe device which has a contact-actuation switch to trigger the rotating light.

Accordingly, a terrestrial globe device comprises a main body which includes a seat, a curved rod disposed on the seat, and a transparent globe positioned by the curved rod. A box which is connected to a lower end of the curved rod has a driving mechanism therein. An integrated circuit board with a contact-actuation switch is disposed in the seat to control the driving mechanism via wires. The box has a first casing and a second casing. A first lobe extends upward from the first casing. A second lobe extends upward from the second casing. The first casing couples with the corresponding second casing. The first lobe, the second lobe and the lower end of the curved rod are fastened together. The driving mechanism comprises a motor, a screw rod connecting the motor, a steering gear abutting the screw rod, a lower gear of a retard gear engaging with a lower end of the steering gear, an upper gear of the retard gear engaging with a gear wheel disposed on a lower end of a voice-producing cylinder, a reed contacting the voice-producing cylinder, a shaft having a lower end extending from the voice-producing cylinder and passing through the box, and a pinion disposed on an upper end of the shaft. A hollow sleeve which connects the lower end of the curved rod is disposed on the box. A hollow toothed disk in contact with the globe is disposed on the hollow sleeve to engage with the pinion. An elastic rod passes through the hollow toothed disk and the hollow sleeve. A bulb socket is disposed on the elastic rod. A bulb is disposed on the bulb socket. A protruded bar is disposed on an upper end of the curved rod and inserted in the transparent globe. The motor drives the screw rod. The screw rod drives the steering gear. The steering gear drives the retard gear. The retard gear drives the gear wheel. The gear wheel drives the pinion. The pinion drives the hollow toothed disk to rotate the globe.

DETAILED DESCRIPTION OF THE INVENTION

Figure 1:
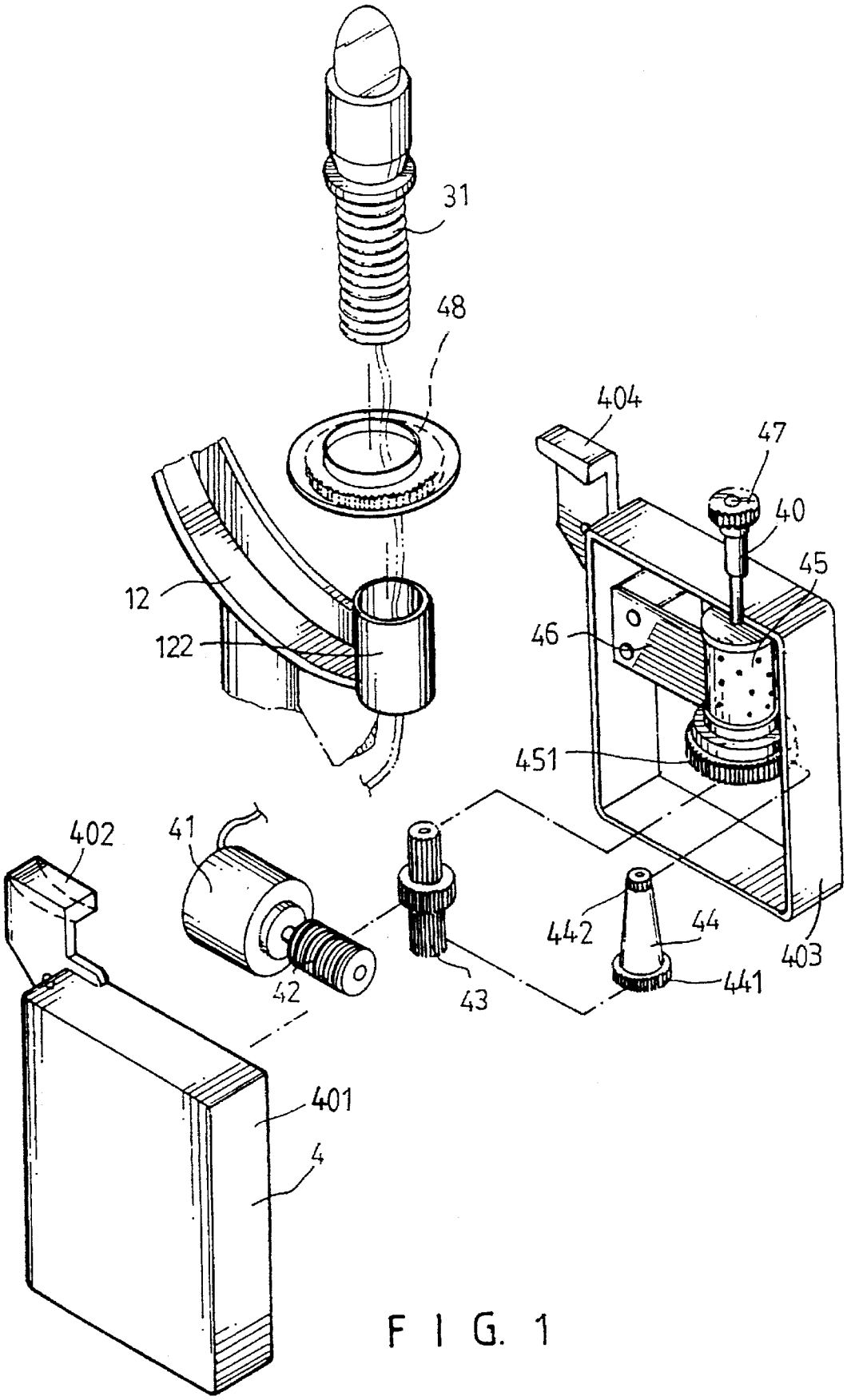
FIG. 1 is a partially perspective exploded view of a terrestrial globe device of a preferred embodiment in accordance with the invention.
Figure 2:
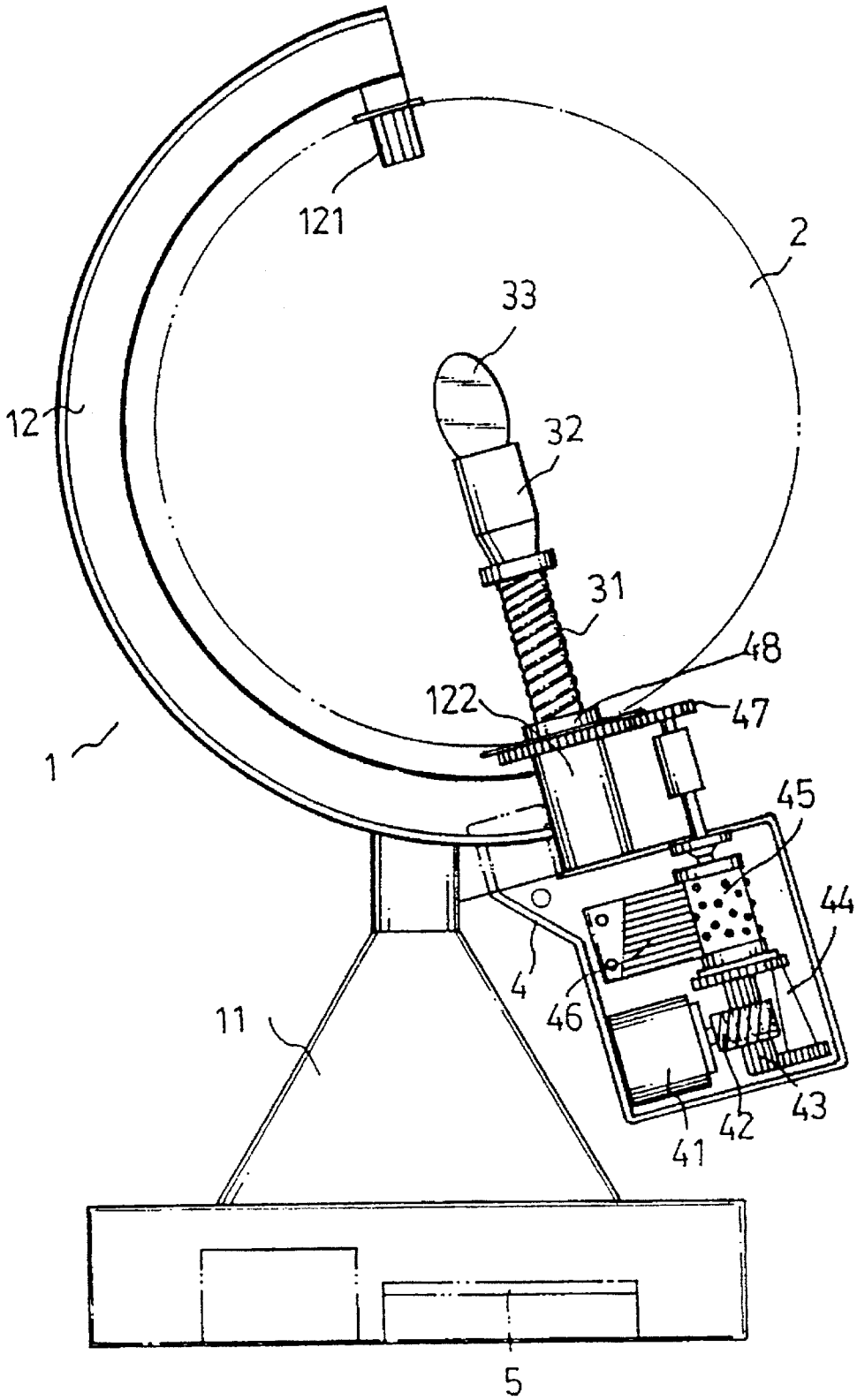
FIG. 2 is a sectional view of a terrestrial globe device.
Figure 3:
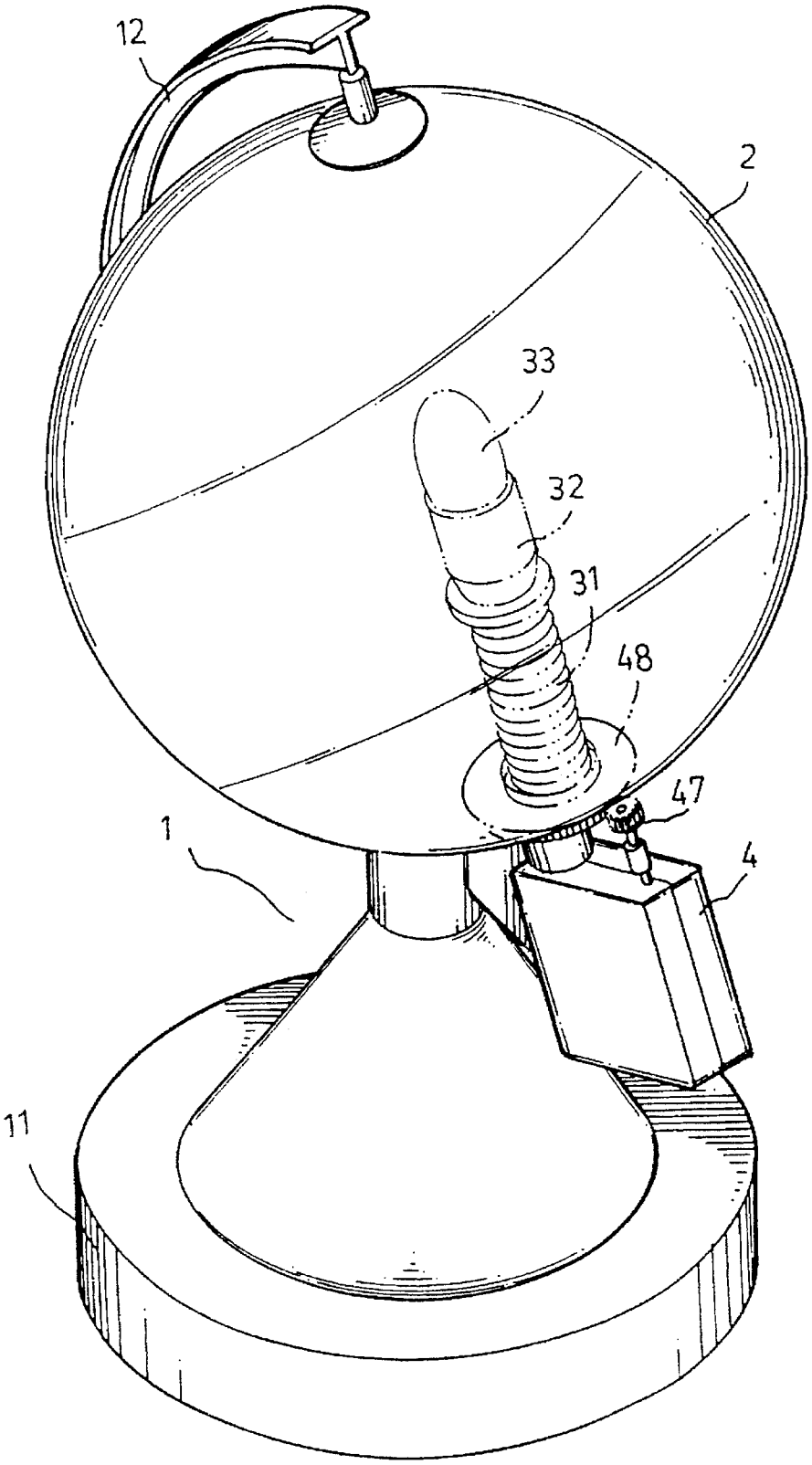
FIG. 3 is a perspective assembly view of a terrestrial globe device.

Referring to FIGS. 1 to 3, a terrestrial globe device comprises a main body 1 which includes a seat 11, a curved rod 12 disposed on the seat 11, and a transparent globe 2 positioned by the curved rod 12. A box 4 which is connected to a lower end of the curved rod 12 has a driving mechanism therein. An integrated circuit board 5 with a contact-actuation switch is disposed in the seat 11 to control the driving mechanism via wires (not shown in the figures). The box 4 has a first casing 401 and a second casing 403. A first lobe 402 extends upward from the first casing 401. A second lobe 404 extends upward from the second casing 403. The first casing 401 couples with the corresponding second casing 403. The first lobe 402, the second lobe 404 and the lower end of the curved rod 12 are fastened together. The driving mechanism comprises a motor 41, a screw rod 42 connecting the motor 41, a steering gear 43 abutting the screw rod 42, a lower gear 441 of a retard gear 44 engaging with a lower end of the steering gear 43, an upper gear 442 of the retard gear 44 engaging with a gear wheel 451 disposed on a lower end of a voice-producing cylinder 45, a reed 46 contacting the voice-producing cylinder 45, a shaft 40 having a lower end extending from the voice-producing cylinder 45 and passing through the box 4, and a pinion 47 disposed on an upper end of the shaft 40. A hollow sleeve 122 which connects the lower end of the curved rod 12 is disposed on the box 4. A hollow toothed disk 48 in contact with the globe 2 is disposed on the hollow sleeve 122 and beneath the globe 2 to engage with the pinion 47. An elastic rod 31 passes through the hollow toothed disk 48 and the hollow sleeve 122. A bulb socket 32 is disposed on the elastic rod 31. A bulb 33 is disposed on the bulb socket 32. A protruded bar 121 is disposed on an upper end of the curved rod 12 and inserted in the transparent globe 2. The motor 41 drives the screw rod 42. The screw rod 42 drives the steering gear 43. The steering gear 43 drives the retard gear 44. The retard gear 44 drives the gear wheel 451. The gear wheel 451 drives the pinion 47. The pinion 47 drives the hollow toothed disk 48 to rotate the globe 2.

The invention is not limited to the above embodiment but various modification thereof may be made. Further, various changes in form and detail may be made without departing from the scope of the invention.

I claim:

1. A terrestrial globe device comprises a main body which includes a seat, a curved rod disposed on the seat, and a transparent globe positioned by the curved rod, a box which is connected to a lower end of the curved rod having a driving mechanism therein, an integrated circuit board with a contact-actuation switch disposed in the seat to control the driving mechanism via wires, wherein the improvement comprising:

the box having a first casing and a second casing, a first lobe extending upward from the first casing, a second lobe extending upward from the second casing, the first casing coupling with the second casing, the first lobe, the second lobe and the lower end of the curved rod fastened together, the driving mechanism comprising a motor, a screw rod connecting the motor, a steering gear abutting the screw rod, a lower gear of a retard gear engaging with a lower end of the steering gear, an upper gear of the retard gear engaging with a gear wheel disposed on a lower end of a voice-producing cylinder, a reed contacting the voice-producing cylinder, a shaft having a lower end extending from the voice-producing cylinder and passing through the box, and a pinion disposed on an upper end of the shaft, a hollow sleeve which connects the lower end of the curved rod disposed on the box, a hollow toothed disk in contact with the globe disposed on the hollow sleeve and beneath the globe to engage with the pinion, an elastic rod passing through the hollow toothed disk and the hollow sleeve, a bulb socket disposed on the elastic rod, a bulb disposed on the bulb socket, a protruded bar disposed on an upper end of the curved rod and inserted in the transparent globe, and wherein the motor drives the screw rod which drives the steering gear which drives the retard gear which drives the gear wheel which drives the pinion and then which drives the hollow toothed disk to rotate the globe.

* * * * *